US005975321A

United States Patent [19]

Luch

[11] Patent Number: 5,975,321

[45] Date of Patent: Nov. 2, 1999

[54] SNAP-ON, SCREW-OFF CAP WITH TAMPER-EVIDENCING SKIRT AND CONTAINER NECK

[75] Inventor: Daniel Luch, Morgan Hill, Calif.

[73] Assignee: Portola Packaging, Inc., San Jose, Calif.

[21] Appl. No.: 09/071,625

[22] Filed: May 1, 1998

Related U.S. Application Data

[63] Continuation-in-part of application No. 08/781,453, Jan. 10, 1997, Pat. No. 5,755,348, which is a continuation of application No. 08/456,741, Jun. 1, 1995, abandoned, which is a division of application No. 08/029,177, Mar. 10, 1993, Pat. No. 5,456,376, which is a continuation-in-part of application No. 07/830,133, Jan. 31, 1992, Pat. No. 5,267,661, which is a continuation-in-part of application No. 07/772,945, Oct. 8, 1991, Pat. No. 5,213,224, which is a continuation-in-part of application No. 07/565,638, Aug. 9, 1990, Pat. No. 5,190,178.

[51] Int. Cl.[6] ..... B65D 41/34

[52] U.S. Cl. ..... 215/256; 215/44; 215/45; 215/318; 215/320; 215/329; 215/354

[58] Field of Search ..... 215/252, 254, 215/256, 253, 318, 329, 330, 354, 356, 357, 341, 307, 320; 220/296, 361, 366, 203.01, 208

[56] References Cited

U.S. PATENT DOCUMENTS

| | | | |
|---|---|---|---|
| 4,930,647 | 6/1990 | Dutt et al. | 215/252 |
| 5,385,252 | 1/1995 | Hidding et al. | 215/230 |
| 5,415,306 | 5/1995 | Luch et al. | 215/256 |
| 5,480,045 | 1/1996 | Molinaro et al. | 215/256 |
| 5,593,055 | 1/1997 | Repp et al. | 215/256 |
| 5,630,520 | 5/1997 | Luch et al. | 215/256 |
| 5,687,866 | 11/1997 | Luch et al. | 215/256 |
| 5,690,243 | 11/1997 | Molinaro | 215/329 |
| 5,775,528 | 7/1998 | Wohlgemuth et al. | 215/256 |

*Primary Examiner*—Stephen K. Cronin
*Attorney, Agent, or Firm*—Julian Caplan; Flehr Hohbach Test Albritton & Herbert LLP

[57] ABSTRACT

A tamper-evidencing, snap-on, screw-off closure is used with a specially shaped container neck. The neck has a neck stretch with multiple neck threads and a locking wall below the neck stretch with a plurality of external teeth. The closure has an upper skirt with multiple closure threads which mate with the neck threads and a tamper-evidencing band with a plurality of internal teeth shaped and positioned to engage the external teeth. The teeth are shaped to guide the teeth into side-by-side interengage during axial application of the cap to the neck.

17 Claims, 6 Drawing Sheets

SNAP-ON, SCREW-OFF CAP WITH TAMPER-EVIDENCING SKIRT AND CONTAINER NECK

CROSS-REFERENCE TO RELATED APPLICATIONS

This application is a continuation-in-part of U.S. Ser. No. 08/781,453, filed Jan. 10, 1997, now U.S. Pat. No. 5,753,348, which in a continuation of U.S. Ser. No. 08/456,741, filed Jun. 1, 1995, now abandoned, which is a division of U.S. Ser. No. 08/029,177, filed Mar. 10, 1993, now U.S. Pat. No. 5,456,376, which is a continuation-in-part of U.S. Ser. No. 07/830,133, filed Jan. 31, 1992, now U.S. Pat. No. 5,267,661, which is a continuation-in-part of U.S. Ser. No. 07/772,945, filed Oct. 8, 1991, now U.S. Pat. No. 5,213,224, which is a continuation-in-part of U.S. Ser. No. 07/565,638, filed Aug. 9, 1990, now U.S. Pat. No. 5,190,178. The disclosures of the above mentioned applications are hereby incorporated herein by reference.

BACKGROUND OF THE INVENTION

1. Field of the Invention

The present invention relates in general to a tamper-evident closure and neck structure for containers. The closure is substantially applied to the container neck with an axial downward force and removed by unscrewing the closure from the neck. The closure includes a tear skirt which ruptures when the closure is initially removed from the container neck to provide visible evidence that the container has been opened.

2. Description of the Related Art

The snap-on, screw-off structures available in the prior art are of two general types—those having thread engagement as initially applied, and those without initial thread engagement. The no-thread initial engagement system has the major advantages of being simple to manufacture and apply and achieving good re-seal on reclosure through the thread torque. However, using a lined closure with this system is somewhat difficult and the consumer may be confused by the requirement of twisting the closure relative to the neck after the container is initially opened by a lifting motion. Examples of closure systems having no-thread initial engagement are those taught by U.S. Pat. No. 4,561,553 to Crisci, and U.S. Pat. No. 4,946,055 to Towns et al.

Systems having partial to full thread engagement after the initial application have several advantages over the no-thread system, including the elimination of consumer confusion. However, the initial thread engagement systems often do not offer the manufacturing and application advantages available with the no-thread-engagement system. With some closure systems, capping equipment which twists the closure relative to the neck must be used at some point during the application process. An example of such a closure is shown in U.S. Pat. No. 4,625,875 to Carr. Other concepts, such as that taught by Miskin in the European Patent Specification No. 0 118 267 do not require orientation or twisting during application, and accommodate for the inevitable closure height variation after application by employing an extended plug to seal against the inside bore of the container neck.

Both the system taught by Carr and Miskin suffer from the requirement that the tamper evidencing band must be expanded over a restrictive container bead during the application process. This requirement leads to application difficulties, especially in the Miskin concept where the rotary assist as taught by Carr is not employed. An additional problem common to both the Carr and Miskin concepts is that the lower tamper evidencing band is joined to the upper closure skirt through bridges requiring mold slides for formation, a feature which greatly increases the cost and complexity of injection molding tooling. Finally, in both the Miskin and Carr concepts the tamper evidencing band remains on the bottle after initial opening, a feature which thwarts effective container recycling.

GB Application No. 2,114,553 to Guala shows an example of a system which is similar to Carr and Miskin. The closure includes a security band formed with axial notches which are adapted receive one of the projections on the exterior of the neck. The closure is applied by pushing the closure onto the neck, with the security band expanding outwardly to pass over the projections on the neck. Unless the cap is perfectly aligned with the neck, the projections will not seat in the notches, requiring the cap be rotated relative to the neck. The Guala closure also must be manufactured using a split mold, increasing the costs and complexity of the tooling.

Other systems available in the art include screw-on, screw-off structures which also offer the advantages of initial thread engagement and elimination of consumer confusion. An example of this type of closure is shown in U.S. Pat. No. 3,980,195 to Fillmore. The system taught by Fillmore includes a threaded, tamper-evidencing closure with a removable band. The interior of the removable band is formed with a one-way ratchet, which cooperates with projections formed on the neck to prevent unscrewing of the container. When the closure is initially twisted onto the neck, the ratchet teeth slip over the projections on the neck. The band must be removed prior to opening the container.

The snap-on, screw-off structures have several advantages not found with the closure taught by Fillmore. The application process used with the screw-on, screw-off systems is quite complex, since the cap must be turned or rotated relative to the container until the closure is fully seated. The frangible connections between the tamper-evidencing band and the closure must be sufficiently strong to prevent partial separation when the cap is twisted onto the container. However, manufacturing variations can result in excessive strength of the frangible connections and the consumer will often have difficulty removing the closure, since the band must first be separated from the rest of the cap.

This invention provides a snap-on, screw off system with partial or full thread initial engagement by reason of a unique thread design and a unique tamper-evidencing band. The present invention offers considerable advantages over prior structures as is evident from the description of the related art and the following description of the invention.

SUMMARY OF INVENTION

The present invention comprises an improved closure or cap and an improved neck finish. The cap skirt and neck are provided with mating threads of such shape that the cap may be applied by pushing the cap onto the neck with a simple downward vertical movement, the cap skirt flexing sufficiently to permit the threads to slip past each other.

The neck finish of the present invention includes a downward extending upper neck stretch portion having at least one helical thread formed on the neck exterior. The closure has a downward extending upper skirt portion depending from a top, the upper skirt portion being adapted to fit over the neck stretch portion. At least one helical thread is formed on the interior of the upper skirt portion, and is shaped to mate with the helical thread formed on the neck.

The closure of the present invention is substantially applied to the neck with a direct, axial downward direction without externally-imposed relative rotation of the neck and the closure. The helical threads are shaped, and the closure is resilient, so that the threads will slip past each other and interengage when the closure is directly applied to the container. The interengagement of the threads requires that the closure be unscrewed for removal from the container. To provide evidence of tampering with the contents of the container, the closure includes a tamper-evidencing band with internal teeth which engage teeth on the neck to restrain unscrewing of the closure from the neck so long as the tamper-evidencing band is intact. The tamper-evidencing band is attached to cap skirt of the closure by a frangible section.

When opening a container, if the consumer is not concentrating on the condition of the cap, he may not notice that the frangible section has been fractured, the cap having been previously removed from the container. Therefore, the preferred embodiment of the present invention further comprises means for removing the tamper-evidencing band from the container, such as a tear tab and a line of weakness which extends upwardly through the tamper-evidencing band. The tear tab is preferably located adjacent this line of weakness. To remove the tamper-evidencing structure from the closure, the consumer pulls the tab, rupturing the line of weakness and the frangible section between the cap skirt and the tamper-evidencing band. Since the tamper-evidencing band is at least partially removed from the closure, tampering with the contents of the container may be detected by even the inattentive consumer.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
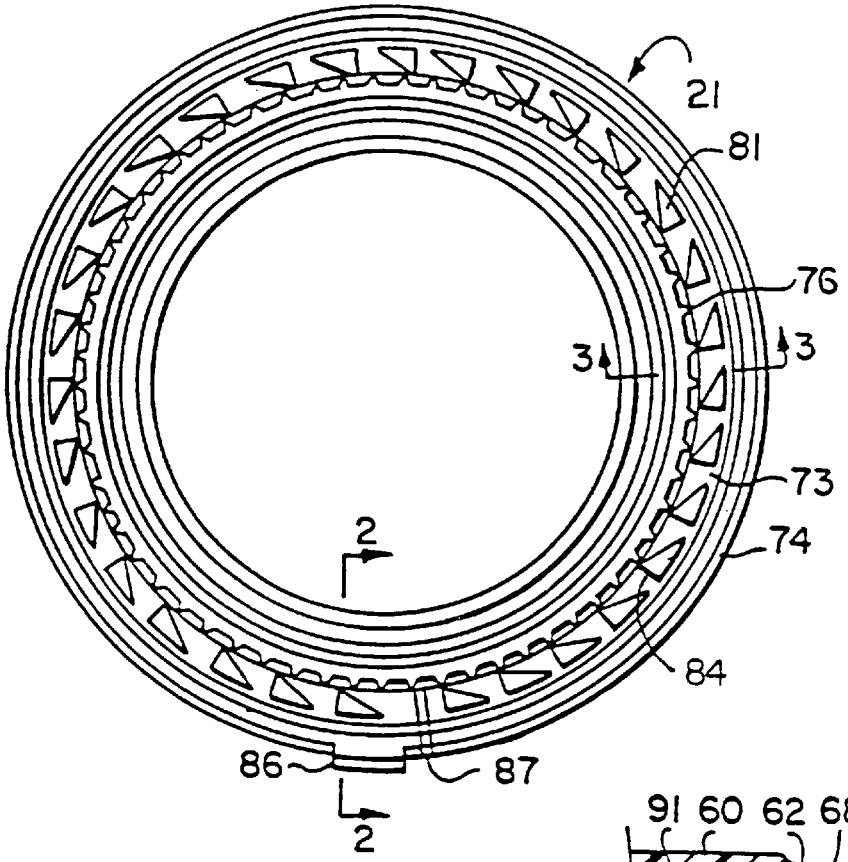
FIG. 1 is a bottom plan view of a cap.
Figure 2:
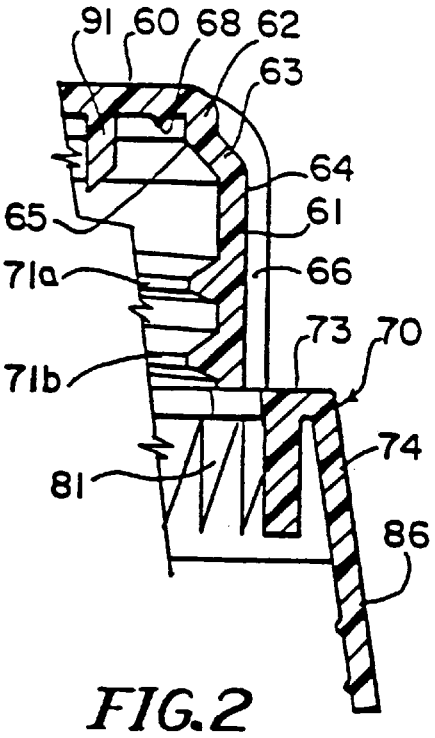
FIG. 2 is an enlarged, fragmentary sectional view of a cap taken along line 2—2 of FIG. 1.
Figure 3:
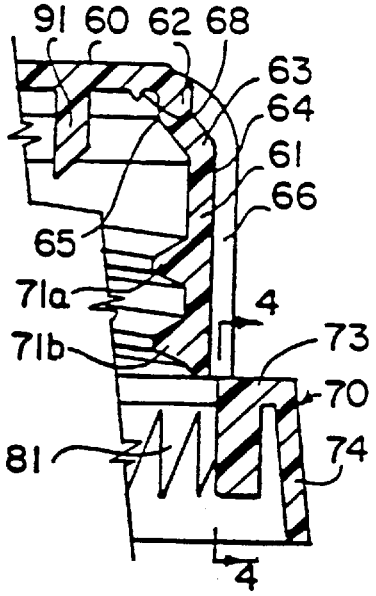
FIG. 3 is an enlarged, fragmentary sectional view of a cap taken along line 3—3 of FIG. 1.
Figure 4:
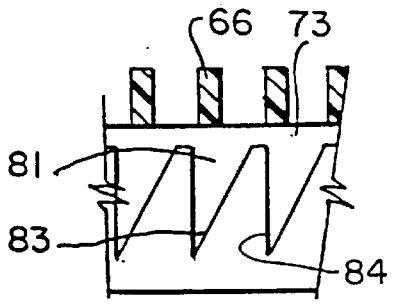
FIG. 4 is an enlarged, fragmentary sectional view taken along line 4—4 of FIG. 3.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Closure 21, hereinafter described in detail, is used with a container neck 22. The interior of the neck forms no part of the present invention. With a blow-molded bottle finish, the interior contour tends to follow that of the neck exterior. However, it will be understood that other types of bottles may be used, with the internal shape of the neck varying from that of the exterior.

Neck 22 has a central opening 23 and a downward-outward slanted lip flange 24 terminating in an upper neck stretch 28. Threads 29 extend outward of stretch 28. In the illustrated embodiment, there are two threads 29*a* and 29*b*. The finish has twelve threads per inch with a double lead, each thread being six pitch and extending slightly in excess of 360° of a full thread. It is to be understood that the threads may be extended greater than 360° for increased thread engagement. Additionally, the thread leads may be of a different linear thread density (threads per inch). The upper flank 36 of thread 29 slants downwardly/outwardly at approximately 45° while the lower flank 37 slants downwardly/inwardly at approximately 10°, permitting the threads on the interior of the cap to slip past the threads on the neck finish. Preferably, the thread apex 38 is made with as large a radius as possible, but being sufficient to insure that the cap must be unscrewed and not pulled from the neck.

Instead of cooperatively shaped threads on the upper neck stretch and the inner surface of the closure, one thread may be replaced by a groove. Further, threads 29 may be interrupted, instead of being continuous.

The container neck includes a tamper-evidencing portion 40 below the upper neck stretch 28 which includes an outward extending shoulder 42, a locking wall 46 offset outwardly relative to the upper neck stretch 28, and a lower outward extending shoulder 47. A plurality of upward projecting teeth 51 are formed on the tamper-evidencing portion of the neck. A vertical stretch 48 depends from shoulder 47. To facilitate gripping the container during filling and loading, vertical stretch 48 may be formed with a number of bumper ring segments 49 (here shown as four in number).

Figure 6:
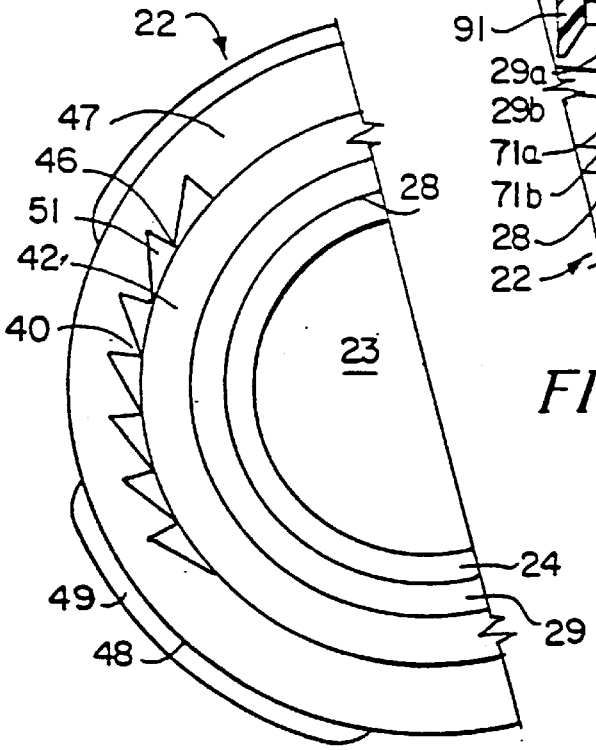
FIG. 6 is a fragmentary, top plan view of a container.

The teeth 51 extend upwardly from the shoulder stretch 47. The teeth are shaped and positioned to cooperate with internal teeth formed on the closure, the interengagement between the teeth resisting unscrewing of the cap from the neck. Typically, multiple teeth 51 (FIG. 6) are formed on either side of neck 22, with the total extent of the multiple teeth being approximately 90°.

A cap for use with neck structure 22 is illustrated in FIGS. 1 to 5. The cap has a top 60 from the periphery of which depends downward extending upper skirt 61. As illustrated, the top comprises a generally flat top disk; however, other configurations may be substituted. The upper skirt 61 is formed with a generally vertical upper edge 62 which merges with outward-downward slanted stretch 63, which in turn merges with vertical stretch 64. An internal shoulder 65 is formed at the intersection of stretches 62 and 63. A sealing bead 68 depends from the underside of top 60. When the cap 21 seats on the neck, bead 68 engages lip flange 24, internal shoulder 65 engages the upper edge of vertical stretch 28 and inner skirt or plug 91 engages lip flange 24, substantially sealing the container. Members 62, 63 and 64 have radially spaced vertical ribs 66 to enable the user to grip the cap.

Figure 5:
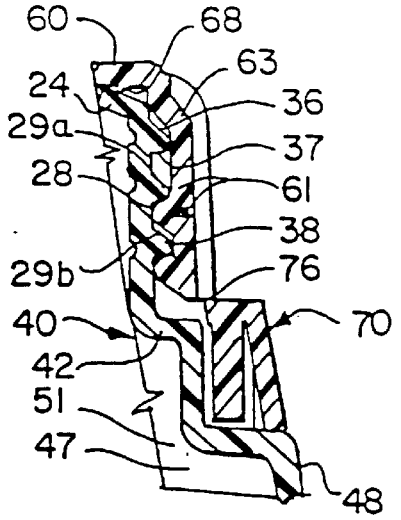
FIG. 5 is an enlarged, fragmentary sectional view of a cap applied to a neck.
Figure 5A:
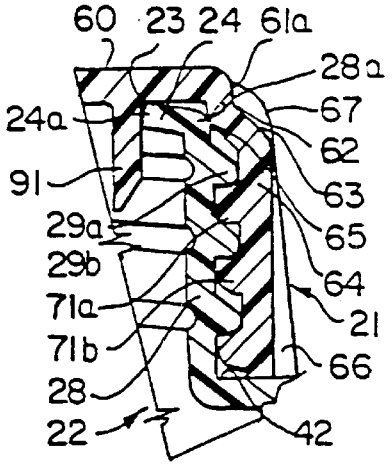
FIG. 5A is an enlarged, fragmentary sectional view of a cap applied to a neck.

As is shown in FIG. 5A, the internal shoulder 65 provides an inward projecting portion 61*a* of the upper skirt 61 which cooperates with the exterior of the neck stretch 28. Since the circumference of the upper portion 28*a* of neck stretch 28 is greater than the interior circumference of the cap 21 at the inward projecting portion 61*a* of the skirt, a tight fit is formed between the inward projecting portion and the neck stretch exterior. The tight fit between the upper skirt portion above thread 71*a* and the exterior of the neck stretch 28 above thread 29*a* promotes an effective seal between the exterior of the plug 91 and the interior edge 24*a* of the lip 24. When the cap 21 is applied to the neck 22, the upper skirt 61 is biased outward as the inward projecting portion 61*a* engages the exterior of the neck stretch 28. Since the closure is resilient, the inner plug 91 of the cap is urged toward the lip 24 to form a seal between the generally seamless interior edge 24*a* of the lip and exterior of the plug 91. In other words, the inward projecting portion provides a means for biasing the upper skirt and the plug outward to urge the plug into sealing engagement with the lip 24. The fit of the shoulder against the neck tends to reduce leakage and rigidify the cap, preventing the cap from being turned or torqued to jump threads or strip the threads. The inner plug 91 of the cap 21 tends to push the neck of the bottle outward against the shoulder and the shoulder then prevents turning or stripping.

Threads 71*a* and 71*b*, which are selected to mate with threads 29 of neck 22, are formed on the interior of the skirt. The shape of threads 29*a*, 29*b*, 71*a*, and 71*b* allow the threads to slip past one another and then interengage. In the presently described embodiment, threads 71*a* and 71*b* are double lead and each extend around the circumference of the cap in excess of 180°, for example, approximately 200°. In conventional capping machines, cap 21 is deposited on neck 22. Since threads 71*a*, 71*b* are diametrically opposed, the cap tends to rest horizontally on neck 22, facilitating the application of the cap onto the neck with a downward, axial force.

In order for the closure and container threads to effectively slip past each other during direct axial application it is necessary that the threads be finer than would be appropriate for a threaded closure applied by conventional rotary application. As threads become finer, a greater amount of total thread engagement is often necessary to prevent excessive forward stripping on reapplication. For the present embodiment, which includes a linear density of twelve threads per inch and is formed with double leads, a thread engagement of approximately 200° for each of the two cap threads is satisfactory (i.e. 400° of total thread engagement). Finer threads such as sixteen or twenty threads per inch would require greater total thread engagement.

The closure includes a tamper-evidencing band 70 below the upper skirt portion 61 provided with a plurality of internal ratchet teeth 81. In the present embodiment, the tamper-evidencing band 70 comprises an annular shoulder 73 below the upper skirt 61 and an outer skirt portion 74 extending downwardly from the shoulder 73. The band 70 is joined to the upper skirt 61 by a frangible section which allows the band 70 to be at least partially torn from the cap. The frangible section includes a number of radially spaced bridges 76 interconnecting the shoulder 73 and the upper skirt portion, the bridges being provided by the lower edges of ribs 66. Alternatively, the frangible section may be provided by a line of weakness formed along the intersection of shoulder 73 and upper skirt 61. In the illustrated embodiment, the shoulder 73 and outer skirt portion 74 divide the band into two sections, with the outer skirt portion being oriented at an angle relative to the annular shoulder. In a modified embodiment, discussed in relation to FIG. 12, the tamper-evidencing band may comprise a single, curved section which extends generally outward and downward from the upper skirt portion. The tamper-evidencing band may also take many other forms.

The tamper-evidencing band includes a plurality of the internal ratchet teeth 81 depending from the shoulder 73. The generally downwardly depending teeth 81 are positioned to engage teeth 51 when cap 21 is pushed onto neck 22. Teeth 81 include an inclined surface 83 for facilitating the application of the cap to neck 22 and a working surface 84 which cooperates with the working surface of one of the teeth 51 on the neck to resist unscrewing of the closure. As the closure is moved downwardly on the neck, the inclined surface 83 slides along tooth 51 to thereby guide tooth 81 to a position between adjacent ones of teeth 51. The downward depending tooth 81 is retained between the teeth 51, with the interengagement between the teeth 51 and 81 securing cap 21 on the neck so long as the tamper-evidencing band 70 is intact. Teeth 81 are located on the shoulder in the present embodiment; however, the teeth may alternatively be positioned at other locations on the tamper-evidencing band 70, such as along the inner surface of outer skirt portion 74.

The interlocking engagement between the teeth on the cap with those on the neck prevents twisting of the cap relative to the container while the tamper-evidencing band 70 is intact. To remove the closure from the neck, the band 70 is at least partially removed from the upper skirt 61 to disengage teeth 81 from the teeth 51 on the neck. The separation of the tamper-evidencing band 70 from the upper skirt 61 is accomplished by rupturing the bridges 76. The ruptured bridges warn the consumer that the container has been opened and the contents tampered with.

A tear tab 86 is connected to the lower edge of the tamper-evidencing band 70. In the present embodiment, the tear tab provides means for removing the lower band and may additionally be used to orient cap 21 relative to the container prior to application if desired. The tamper-evidencing band 70 is formed with a line of weakness adjacent tab 86, generally indicated by 87, extending through outer skirt portion 74 and shoulder 73 of the band. The line of weakness facilitates removal of the band 70 from the closure, and is another tamper-evidencing feature of the present invention. When initially opening the container, the consumer pulls tab 86 to remove lower band 70, rupturing line 87 and frangible section 76. The absence of the band 70 more dramatically alerts the consumer to possible tampering with the contents. An inattentive consumer may fail to notice the fractured bridges, therefore the removal of the tamper-evidencing band is a more obvious indication of tampering. In the preferred form, completely removing lower band 70 from upper skirt 61 aesthetically enhances the appearance of cap 21, which is used to reseal the container. However, in other forms of the present invention the lower band may be only partially removed from the upper skirt portion for separating teeth 51 from teeth 81 to unscrew the cap from the container.

When a consumer desires to initially open the container, he grips tab 86 and pulls circumferentially around the container detaching lower band 70 from upper skirt 61. Ratchet teeth 81 are thereby removed from interlocking engagement with upward projecting teeth 51, enabling the consumer to unscrew cap 21 from neck 22 and providing evidence that the container has been opened. To replace the cap, the consumer merely reverses the direction of twisting.

Figure 8:
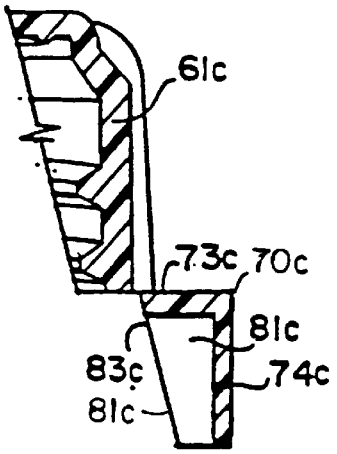
FIG. 8 is an enlarged, fragmentary sectional view taken along line 8—8 of FIG. 7.
Figure 7:
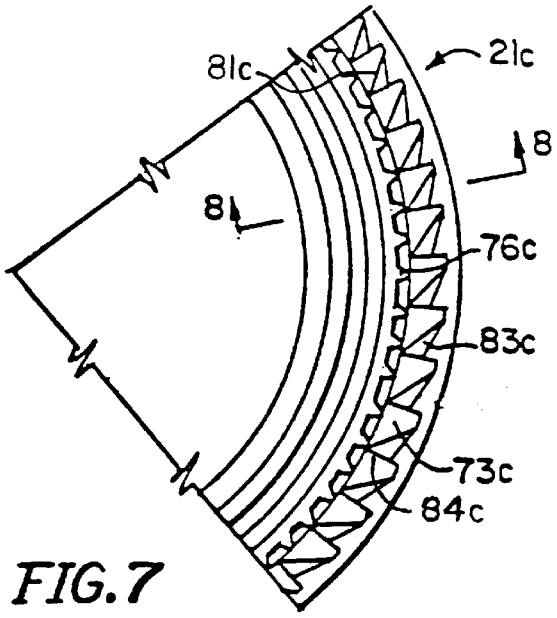
FIG. 7 is a fragmentary, bottom plan view of an another embodiment of a cap.

A modification of the cap is shown in FIGS. 7 and 8. The modified cap 21*c* may be applied to a container having a neck configuration similar to that shown in FIG. 6. The cap 21*c* includes a tamper-evidencing band 70*c* which includes a number of downward depending teeth 81*c*. The shoulder 73*c* of the band extends horizontally outward from the lower edge of upper skirt portion 61*c*, and the outer skirt portion 74*c* depends from the shoulder. A frangible section composed of a plurality of circumferentially spaced bridges 76*c* connects shoulder 73*c* to the lower edge of upper skirt 61*c*. The teeth 81*c* are dimensioned and positioned to engage the upwardly extending teeth 51 formed on the neck. To facilitate application of cap 21*c*, teeth 81*c* include a beveled inner surface 83*c*. When pushing the closure onto the neck, inner surface 83*c* directs the teeth 81*c* into interengagement with teeth 51. The working surface 84*c* engages the working surface of one of the teeth 51 on the neck to resist unscrewing of the cap 21*c* from the neck.

Teeth 81*c* and teeth 51 cooperate to restrain unscrewing of cap 21*c* relative to the neck while the lower skirt remains intact. To unscrew the cap, lower band 70*c* is removed from upper skirt portion 61*c* by rupturing frangible bridges 76*c*. The modified cap may include a tear tab and a line of weakness extending through the lower skirt, as described with reference to the previously discussed embodiment for facilitating removal of tamper-evidencing band 70*c*. Alternatively, cap 21*c* may be twisted, fracturing the bridges, and unscrewed from the container with lower band 70*c* remaining around neck 22. The use of a tear tab and line of weakness is preferred, as it provides a clearer and more obvious indication of tampering, facilitates recycling of the container and substantially eliminates risk of injury to wildlife.

Figure 9:
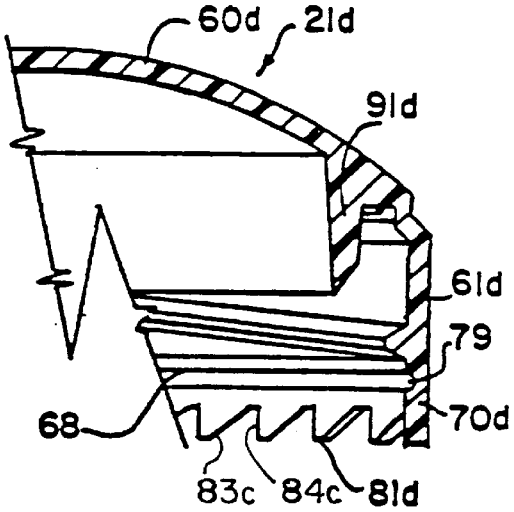
FIG. 9 is an enlarged, fragmentary side elevational view of an alternative embodiment of a cap, shown partly in cross section.
Figure 10:
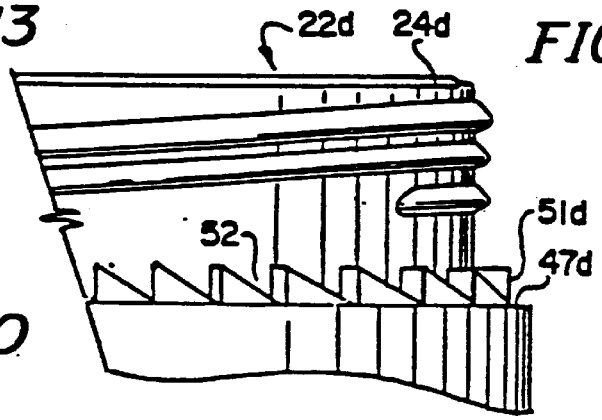
FIG. 10 is an enlarged, fragmentary side elevational view of an alternative embodiment of a neck.
Figure 11:
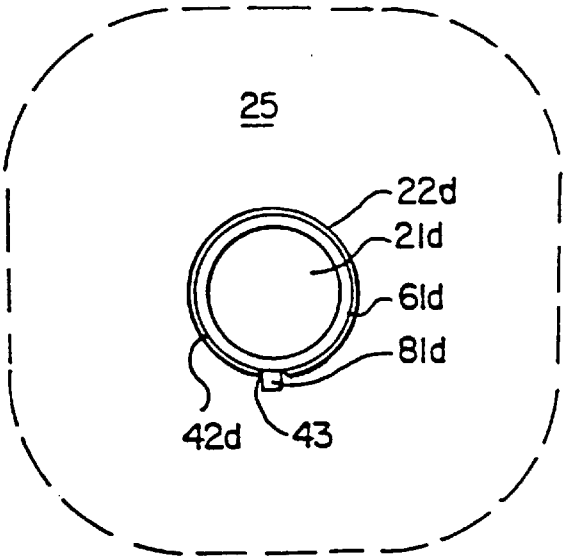
FIG. 11 is a fragmentary, top plan view showing the cap applied to a container.

An alternative modification of the cap 21*d* and neck 22*d* of the present invention is shown in FIGS. 9 to 11. Neck 22*d* is formed with several teeth 51*d* circumferentially spaced along shoulder stretch 47*d*. A pair of adjacent teeth 51*d* are separated by a space, generally designated 52, formed for receiving the teeth of the closure. When the closure is applied to the neck, a tooth formed on the closure is positioned within space 52 between the adjacent teeth 51*d*, thereby preventing rotation of the closure relative to the neck.

Cap 21*d* (FIG. 9) includes a domed top 60*d* having an inner skirt 91*d* depending from the underside of the domed top. Inner skirt 91*d* engages lip flange 24*d* when the cap seats on the neck, forming an internal seal between the cap and the neck. In this embodiment, the lower band portion 70*d* comprises a number of teeth 81*d* generally depending from lower edge 68 of upper skirt 61*d*. The tamper-evidencing means are provided by the teeth 81*d*. The teeth 81*d* are shaped and positioned for interengaging teeth 51*d*, with one tooth 81*d* slipping into space 52 as the cap 21*d* is applied to neck 22*d*. The teeth 81*d* have an inclined surface 83*d* which slides along the tooth 51*d* to position the tooth 81*d* in the space 52. The working surface 84*d* of the tooth engages the tooth 51*d* on the neck to resist unscrewing of the cap 21*d* relative to the neck 22*d*. The interengagement between teeth 51*d* and teeth 81*d* substantially restricts twisting of the closure relative to the neck, preventing unscrewing of the cap with the tamper-evidencing structure intact.

To remove cap 21*d* from neck 22*d*, the band 70*d*, which is formed with the downward depending teeth 81*d*, must be severed from upper skirt portion 61*d*. As is shown in FIG. 9, a line of weakness 79 extends about the circumference of the closure between the upper skirt portion 61*d* and the band 70*d*. To open the container for the first time, the band 70*d* is torn away at the line of weakness, facilitating unscrewing of the closure. Removal of the band 70*d* is facilitated by a tear tab which is gripped while initiating a continuing tearing away of the lower skirt portion. As is shown in FIG. 11, one of the downward extending teeth 81*d* may be extended to provide a tear tab. When the cap is applied to the neck, the tear tab is deformed outward by depressed section 43 of shoulder stretch 47*d*. The consumer grips the tear tab shown in FIG. 11 and removes the lower band portion 70*d* to separate the interengaged teeth 51*d* and 81*d* and open the container.

Figure 12:
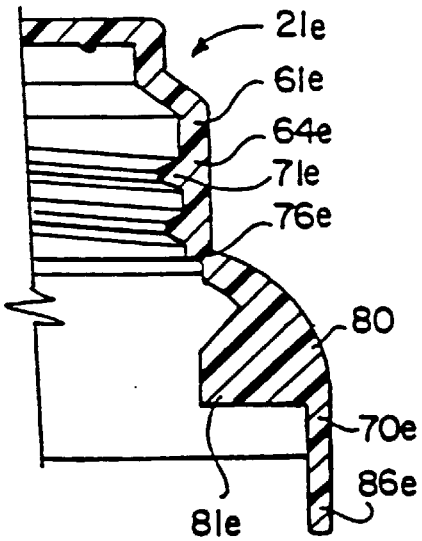
FIG. 12 is an enlarged, fragmentary side elevational view of another embodiment of a cap.

Another modification of a cap 21*e* of the present invention is shown in FIG. 12. The cap 21*e* may be used with a neck of the type shown in FIG. 6. The cap 21*e* includes an upper skirt 61*e* having a generally vertical portion 64*e* and a lower band portion 70*e*. The lower band 70*e* extends generally outward and downward from the lower edge of vertical portion 64*e*, and is formed with a curved section 80. A number of internal teeth 81*e* are formed on the interior of the curved section 80 of the lower band. A frangible section, provided in the present embodiment by a line of weakness 76*e*, joins the lower band 70*e* to the upper skirt portion 61*e*. A tear tab 86*e* depends from the lower band 70*e*. When the cap 21*e* is applied to the neck 22, threads 71*e* slip past and interengage threads 29. Curved section 80 slips over outward extending shoulder 42 and lower neck portion 46, with the teeth 81*e* being shaped and positioned to interengage teeth 51. As with the previously described modifications, to open the container the consumer pulls tab 86*e*, fractures the line of weakness 76*e* and separates the lower band from the upper skirt, disengaging teeth 81*e* from teeth 51.

Figure 13:
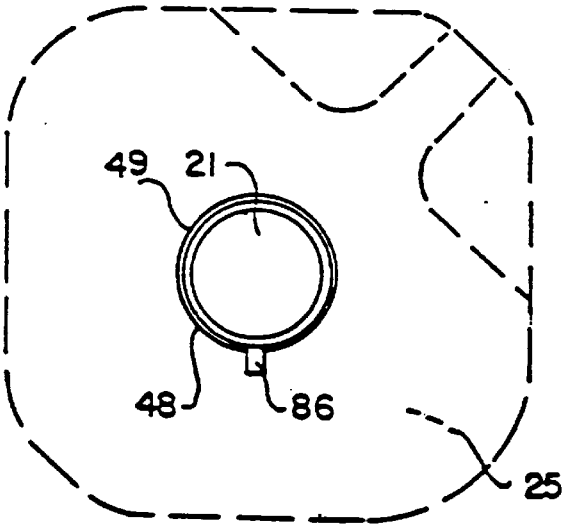
FIG. 13 is a top plan view of a cap applied to a container.

Turning to FIG. 13, cap 21 is shown seated on container 25. With the present invention, the closure may be conveniently oriented relative to the container prior to applying the closure to the neck. The tab 86 and the non-circular cross section of the container are directed by the capping machine during the capping process to align the cap and container relative to one another, positioning teeth 51 and 81 for direct interengagement when the cap is pushed onto the neck. However, the cap construction of the previous embodiments fosters substantial seating of the cap without prior orientation. For example, the locking means of the closure and neck are cooperatively shaped to slip past one another, thereby guiding the teeth 81 formed on the closure into interengagement with the teeth 51 formed on the neck. By first orienting the cap, full thread engagement may be achieved once the cap is pushed onto the neck. However, it is to be understood that in many instances, full thread engagement or complete interengagement of the teeth 51 and 81 is not necessary to securely retain the cap on the container. The various features of the present invention are not to be restricted to a snap-on, screw-off closure system in which the cap and container are first oriented relative to one another.

Figure 16:
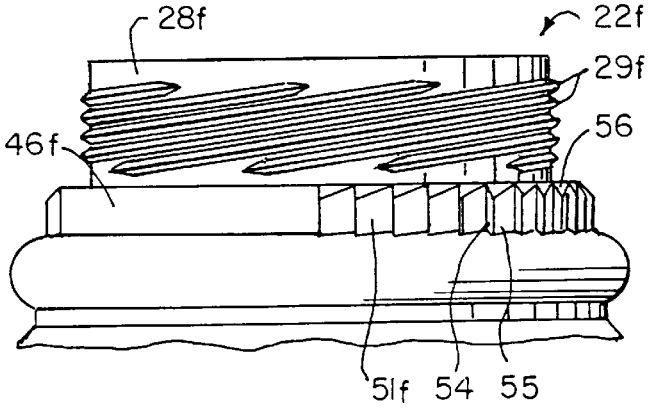
FIG. 16 is a side elevational view of another embodiment of a neck.
Figure 17:
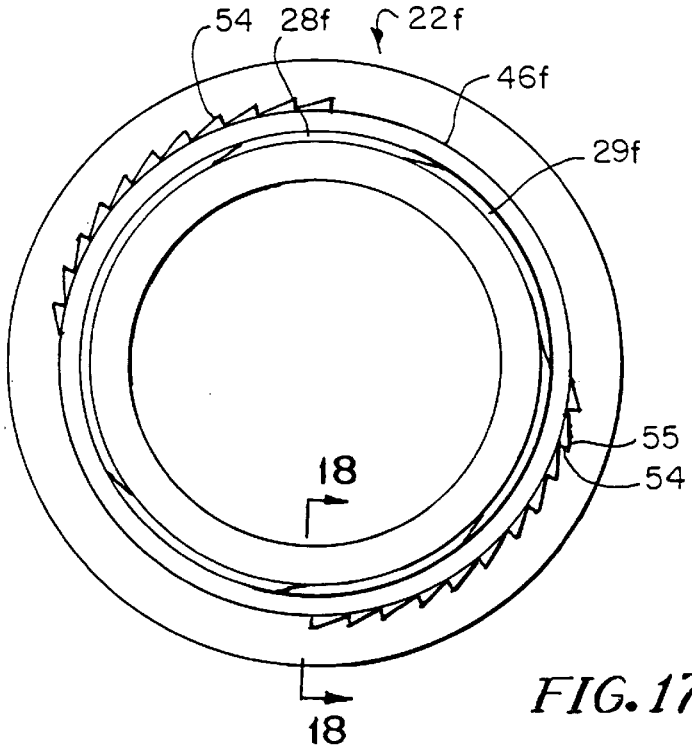
FIG. 17 is a top plan view of the neck of FIG. 16.

FIGS. 16–20 illustrate another embodiment of a neck 22*f* and cap 21*f* in accordance with the present invention. The neck 22*f* includes multiple threads 29*f* on the upper neck stretch 28*f*. As shown in FIG. 17, the neck 22*f* includes seven threads 29*f* although it is to be understood that a greater number of threads may be employed if desired. In this embodiment, the thread finish has a linear thread density of more than 17 threads per inch, for example 17.5 threads per inch, and each thread extends more than 200°, for example 215°, around the circumference of the upper neck stretch 28*f*. The thread density and length of each thread are also subject to variation within the scope of this invention.

A plurality of teeth 51*f* are formed on the locking wall 46*f* of the neck 22*f*. As shown particularly in FIG. 17, the teeth 51*f* include a working surface 54 and a trailing surface 55. The working surface 54 engages the working surface of a tooth on the cap to resist unscrewing of the cap relative to the neck. The trailing surface 55 joins the outer edge of the working surface 54 of one tooth 51*f* to the inner edge of the working surface 54 of the adjacent tooth as shown in FIG. 17. In other modifications of the invention, the teeth 51*f* may be spaced apart so that the trailing surface 55 ends at the locking wall 46*f* and is not joined to the adjacent tooth. The trailing edges 55 allow the cap 21*f* to be twisted slightly, usually no more than about 50°, to fully seat the cap on the neck after the cap has been substantially applied by pushing the cap in an axial direction onto the neck.

Figure 18:
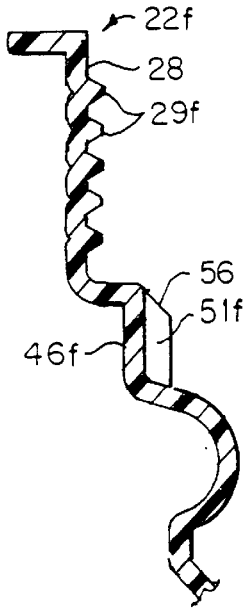
FIG. 18 is an enlarged, fragmentary sectional view taken along line 18—18 of FIG. 17.

As shown particularly in FIGS. 16 and 18, each tooth 51*f* includes a bevel 56 at the upper edge of the tooth 51*f*. The bevels 56 slant downwardly and outwardly to guide the cap teeth 81*f* into side-by-side interengagement with the teeth 51*f*. In the embodiment of FIGS. 16–18, the bevel 56 is inclined at an angle of about 40° to 50°, such as 45°, relative to a horizontal plane. However, a bevel of an angle in the range of 10° to 70° may be employed.

Figure 19:
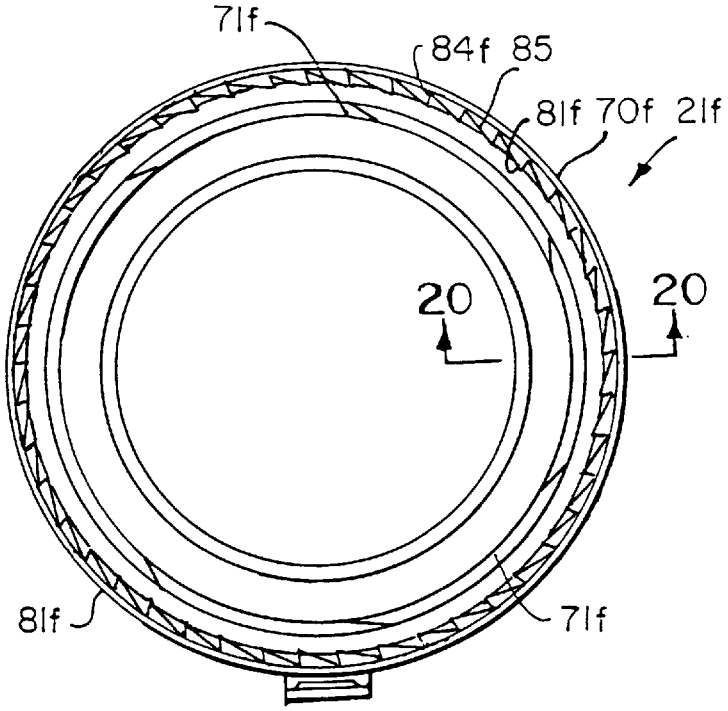
FIG. 19 is a bottom plan view of another embodiment of a cap.
Figure 20:
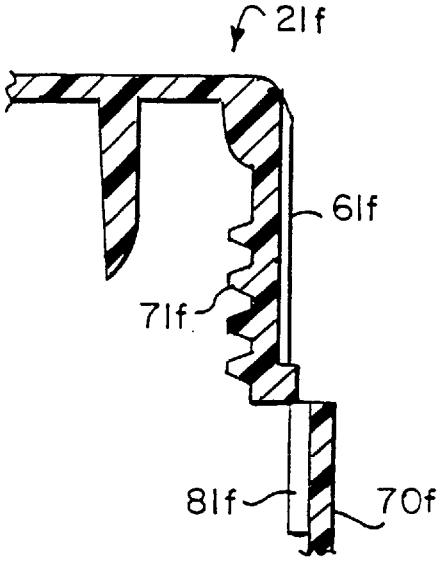
FIG. 20 is an enlarged, fragmentary sectional view taken along line 20—20 of FIG. 19.

The cap 21*f* is shown in FIGS. 19 and 20. The cap 21*f* includes multiple threads 71*f* on the interior of the upper skirt 61*f* which mate with the multiple threads 29*f* on the upper neck stretch 28*f*. In the illustrated embodiment, the cap 21*f* includes seven threads each having a length of about 180°, and the thread finish has a linear thread density of more than 17 threads per inch, such as 17.5 threads per inch. As with threads 29*f*, it is to be understood that the number of threads, the length of the individual threads, and the linear thread density is subject to considerable variation within the scope of the present invention.

A plurality of teeth 81*f* are provided on the interior of the tamper-evidencing band 70*f*. In the illustrated embodiment, teeth 81*f* are formed around the entire circumference of the band 70*f*, however in other embodiments the teeth 81*f* may be arranged in groups spaced around the interior of the band 70*f*. The teeth 81*f* have a working surface 84*f* and a trailing surface 85. The working surface 84*f* cooperates with the working surface 54 of the teeth 51*f* on the neck to resist unscrewing of the cap 21*f* from the neck 22*f*, while the trailing surface 85 joins the outer edge of the working surface 84*f* to either the inner edge of the working surface 84*f* of an adjacent tooth or ends at the inner wall of the band 70*f*. When the cap 21*f* is moved downwardly onto the neck 22*f* in an axial direction, the lower edge of some of the teeth 81*f* contact the bevel 56 on the teeth 51*f*, which guides the teeth 81*f* into side-by-side engagement with the teeth 51*f*.

Figure 21:
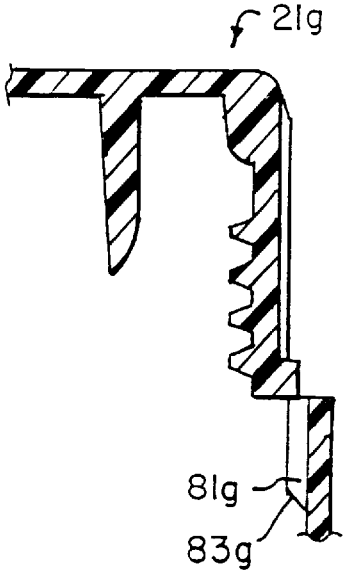
FIG. 21 is view similar to FIG. 20 of another embodiment of a cap.

In this embodiment shown in FIGS. 19 and 20, the downward slope of the working surface 84*f* and the trailing surface 85 follows the slope of the band 70*f*. In this instance, both the band 70*f* and the surfaces 84*f* and 85 are substantially vertical corresponding to the substantially vertical orientation of the locking wall 46*f*. However, the band 70*f* may also be slanted downwardly and outwardly as shown for example by the band 70 in FIGS. 1–5. The bottom or lower edge of the teeth 81*f* of the embodiment shown in FIGS. 19–20 is substantially horizontal. When the neck 22*f* is used with the cap 21*f*, the bevels 56 provide the primary means for guiding the teeth 51*f* and the teeth 81*f* into interengagement. The neck 22*f* may also be used with other caps such as a cap 21*g* shown in FIG. 21. The teeth 81*g* of the cap 21*g* have a bevel or inclined surface 83*g* which is slanted in a downward-outward direction. The bevel 83*g* cooperates with the bevel 56 to guide the teeth 51*f* and 81*g* into side-by-side interengagement. The neck 22*f* may also be used with caps of the type shown in FIGS. 1–6 and FIGS. 7–8, modified to include threads matching the thread pattern on the neck 21*f*.

Except as set forth above, the modifications of FIGS. 7–8, 9–11, 12, 16–20 and 21 resemble those of the preceding modifications and the same reference numerals followed by the subscripts c–g, respectively, are used to designate corresponding parts.

PREFERRED OPERATION

Figure 14:
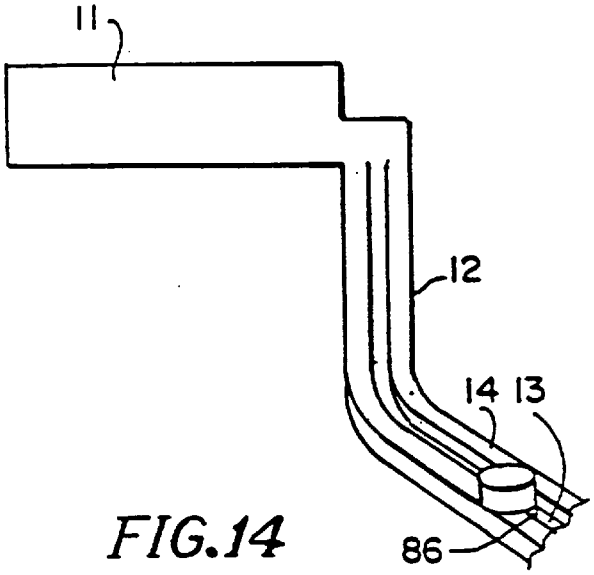
FIG. 14 is a fragmentary plan view of a capping machine, showing a cap positioned within the chute.

After the container has been filled, it is transported through a capping machine. The structure of capping machines is well known in the bottling art. As is well understood in the art, and in a manner similar to that whereby push-on, pull-off caps are applied, caps 21 are fed one at a time out of a bowl 11 in the capping machine along a chute 12 (FIG. 14). One type of chute 12 is formed with a slot 13 between parallel rails 14, with tear tab 86 orienting the caps for uniform discharge in a pre-determined orientation relative to the containers passing therebelow by fitting into the space 13 between the rails 14. Chutes without slots may be used when the tab does not depend from the lower edge of the tamper-evidencing band or when the cap is not oriented relative to the neck before it is applied.

Figure 15:
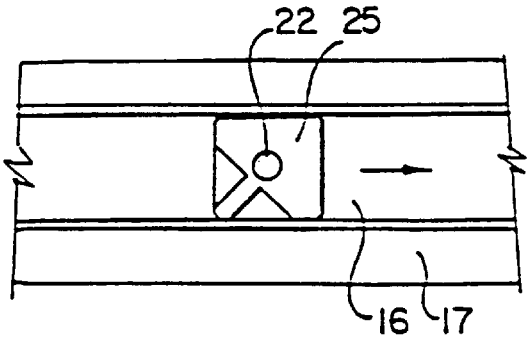
FIG. 15 is a partial top plan view of a capping machine, showing a container positioned on the conveyor belt.

When orientation is employed, each container 25 preferably has a non-circular cross section or some other variation from a round shape, such as the rectangular shape shown in FIG. 13, which permits the container to be oriented relative to cap 21. The container 25 travels along a conveyer belt 16 below the capping machine (FIG. 15). Guide rails 17 adjacent the conveyor belt 16 directionally align the non-circular cross section of the container 25 relative to the tear tab 86 of the cap. Using the slot 13 between the parallel rails 14 and the guide rails 17, the cap 21 and neck 22 may be conveniently oriented relative to one another by the conventional capping machine and conveyor belt system.

As is well known in the art, the container passes below the chute and picks up a cap 21 such that the cap is resting on the neck 22. If orientation is employed, the threads 29 and 81 are in vertical alignment, ensuring full thread engagement. Otherwise, the orientation of the cap relative to the neck is random. An axially downward force is applied to the cap, pushing the cap onto the neck without externally imposed relative rotation of the cap and container. Threads 71*a* and 71*b* slip over threads 29*a* and 29*b*, the slanted surfaces 36 facilitating such movement. The cap is sufficiently resilient so that it expands outward to permit the threads to slip. As cap 21 seats on the neck, teeth 81 fall behind teeth 51, providing interengagement between teeth 51 and teeth 81. The inclined surfaces 83 of teeth 81 and/or bevels 56 of teeth 51*f* guide the teeth 81 and 51, 51*f* into interengagement. After the cap has been fully seated on neck 22, it may not be removed without providing evidence of tampering. The interengagement between teeth 51 and 81 prevent unscrewing of the cap from the container, while the interengagement between the threads prevents lifting of cap 21 off neck 22.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a container having a neck and a container closure, said neck having an upper opening, a lip surrounding said opening, a downward extending neck stretch below said lip, said neck stretch having an exterior, multiple neck helical engagement means on said exterior of said neck stretch, a locking wall below said neck stretch, and a plurality of external teeth on said locking wall, said closure having a top, a downward extending upper skirt depending from said top adapted to fit over said neck stretch, said upper skirt having an interior, multiple closure helical engagement means on said interior of said upper skirt shaped to engage said neck helical engagement means, a tamper-evidencing band frangibly attached to said upper skirt, a plurality of internal teeth on said tamper-evidencing band interengaging said external teeth to prevent unscrewing of said closure from said neck so long as said tamper-evidencing band is intact, said neck and closure helical engagement means being shaped and said closure being resilient so that upon application of force to accomplish direct, axial movement of said closure relative to said container without externally imposed relative rotation of said closure and said neck, said neck and closure helical engagement means slip past each other and then interengage and said closure seats on said neck so that said closure cannot be removed from said neck without unscrewing said closure, said external teeth having a bevel slanted downwardly and outwardly from said locking wall, said bevel guiding said internal teeth and said external teeth into side-by-side interengagement upon contact between at least one of said internal teeth and said bevel of at least one of said external teeth during said direct, axial movement of said closure relative to said neck.

2. The combination of claim 1 in which said external teeth having a working surface engaging one of said internal teeth and a trailing surface joined to said working surface.

3. The combination of claim 1 in which said internal teeth having a working surface engaging one of said external teeth and a trailing surface joined to said working surface.

4. The combination of claim 1 in which said internal teeth have an inclined surface for guiding said teeth into side-by-side interengagement upon contact between said inclined surface of at least one of said internal teeth and at least one of said external teeth.

5. The combination of claim 1 in which said closure and neck helical engagement means are screw threads, said closure and neck helical engagement means each having a linear thread density of at least twelve threads per inch.

6. The combination of claim 1 in which said closure includes a tab joined to said tamper-evidencing band for at least partially separating said tamper-evidencing band from said upper skirt.

7. The combination of claim 6 in which said tamper-evidencing band includes a line of weakness extending through said tamper-evidencing band vicinal said tab for splitting said tamper-evidencing band during removal of said tamper-evidencing band from said upper skirt.

8. A container having a neck for use with a container closure of the type having a top, a downward extending upper skirt depending from said top, said upper skirt having an interior, multiple closure helical engagement means formed around said interior of said upper skirt, a tamper-evidencing band frangibly attached to said upper skirt, and a plurality of internal teeth on said tamper-evidencing band, said neck having an upper opening, a downward extending neck stretch below said opening, said neck stretch having an exterior, multiple neck helical engagement means formed around said exterior of said neck stretch shaped to mate with the closure helical engagement means, a locking wall below said neck stretch, and a plurality of external teeth on said locking wall shaped to engage the internal teeth to resist unscrewing of the cap from said neck after the closure is applied to said neck, said neck helical engagement means being shaped to slip over the closure helical engagement means when the closure is applied to said neck so that, upon application of force to accomplish direct, axial movement of the closure relative to said container without externally imposed relative rotation of said neck and the closure, said neck helical engagement means and the closure helical engagement means slip past one another and interengage and the closure seats on said neck so that the closure cannot be removed from said neck without unscrewing the closure, said external teeth having a bevel slanted downwardly and outwardly from said locking wall, said bevel guiding said internal teeth and said external teeth into side-by-side interengagement upon contact between at least one of said internal teeth and said bevel of at least one of said external teeth during said direct, axial movement of said closure relative to said neck.

9. The container of claim 8 in which said external teeth having a working surface engaging one of said internal teeth and a trailing surface joined to said working surface.

10. The container of claim 8 in which said neck helical engagement means are screw threads, said neck helical engagement means having a linear thread density of at least twelve threads per inch.

11. In combination, a container having a neck and a container closure, said neck having an upper opening, a lip surrounding said opening, a downward extending neck stretch below said lip, a plurality of external threads on said neck stretch, a locking wall below said neck stretch, and a plurality of external teeth on said locking wall, said closure having a top, an upper skirt depending from said top adapted to fit over said neck stretch, a plurality of internal threads on said upper skirt shaped to engage said external threads, a tamper-evidencing band frangibly attached to said upper skirt, a plurality of internal teeth on said tamper-evidencing band interengaging said external teeth to prevent unscrewing of said closure from said neck so long as said tamper-evidencing band is intact, said internal and external threads being shaped and said closure being resilient so that upon application of force to accomplish direct, axial movement of said closure relative to said container without externally imposed relative rotation of said closure and said neck, said internal and external threads slip past each other and then interengage and said closure seats on said neck so that said closure cannot be removed from said neck without unscrewing said closure, said external teeth having a bevel slanted downwardly and outwardly from said locking wall, said bevel guiding said internal teeth and said external teeth into side-by-side interengagement upon contact between at least one of said internal teeth and said bevel of at least one of said external teeth during said direct, axial movement of said closure relative to said neck.

12. The combination of claim 11 in which said external teeth having a working surface engaging one of said internal teeth and a trailing surface joined to said working surface.

13. The combination of claim 11 in which said internal teeth having a working surface engaging one of said external teeth and a trailing surface joined to said working surface.

14. The combination of claim 11 in which said internal teeth have an inclined surface for guiding said teeth into side-by-side interengagement upon contact between said inclined surface of at least one of said internal teeth and at least one of said external teeth.

15. The combination of claim 11 in which said closure threads and said neck threads each have a linear thread density of at least twelve threads per inch.

16. The combination of claim 11 in which said closure includes a tab joined to said tamper-evidencing band for at least partially separating said tamper-evidencing band from said upper skirt.

17. The combination of claim 16 in which said tamper-evidencing band includes a line of weakness extending through said tamper-evidencing band vicinal said tab for splitting said tamper-evidencing band during removal of said tamper-evidencing band from said upper skirt.

* * * * *